US010663921B2

(12) United States Patent
Shiratori et al.

(10) Patent No.: US 10,663,921 B2
(45) Date of Patent: May 26, 2020

(54) IMAGE FORMING APPARATUS AND DEW CONDENSATION COUNTERMEASUREMENT SYSTEM

(71) Applicant: CANON KABUSHIKI KAISHA, Tokyo (JP)

(72) Inventors: Toshinori Shiratori, Suntou-gun (JP); Keita Nakajima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/529,949

(22) Filed: Aug. 2, 2019

(65) Prior Publication Data

US 2020/0041956 A1 Feb. 6, 2020

(30) Foreign Application Priority Data

Aug. 3, 2018 (JP) ..... 2018-146489

(51) Int. Cl.
*G03G 15/20* (2006.01)
*G03G 21/20* (2006.01)

(52) U.S. Cl.
CPC ..... *G03G 21/206* (2013.01); *G03G 15/2017* (2013.01); *G03G 21/203* (2013.01)

(58) Field of Classification Search
CPC . G03G 15/2017; G03G 21/203; G03G 21/206
See application file for complete search history.

(56) References Cited

U.S. PATENT DOCUMENTS 4,645,327 A * 2/1987 Kimura ..... G03G 15/161 219/216
5,223,902 A * 6/1993 Chodak ..... G03G 15/206 399/328
5,512,975 A * 4/1996 Kitsu ..... G03G 15/2064 399/130
7,865,122 B2 * 1/2011 Koyama ..... G03G 15/6573 399/341
8,554,104 B2 * 10/2013 Shimoyama ..... G03G 15/2064 399/327
8,909,088 B2 * 12/2014 Murooka ..... G03G 15/2042 399/92
8,965,239 B2 * 2/2015 Kaino ..... G03G 15/206 399/92
2006/0110172 A1 * 5/2006 Iijima ..... G03G 15/2003 399/44
2006/0147223 A1 * 7/2006 Nishimura ..... G03G 15/6573 399/92
2007/0059019 A1 * 3/2007 Kasama ..... G03G 15/6573 399/91
2010/0003048 A1 * 1/2010 Yamazoe ..... G03G 15/6579 399/92

(Continued)

FOREIGN PATENT DOCUMENTS

JP 0990855 A 4/1997

OTHER PUBLICATIONS

Machine translation of JP 09090855 (Year: 1997).*

*Primary Examiner* — David J Bolduc
(74) *Attorney, Agent, or Firm* — Venable LLP

(57) ABSTRACT

An image forming apparatus includes an image forming portion, a fixing portion, a duct and a water vapor moving portion through which water vapor generated in the fixing portion moves. The water vapor moving portion is cooled by air blowing in the duct.

15 Claims, 7 Drawing Sheets

(56) References Cited

U.S. PATENT DOCUMENTS

2010/0329726 A1* 12/2010 Kasuga ..... G03G 15/2064 399/92
2012/0141173 A1* 6/2012 Iwasaki ..... G03G 15/2025 399/327
2012/0148290 A1* 6/2012 Asami ..... G03G 15/2042 399/92
2013/0004221 A1* 1/2013 Honda ..... G03G 15/6502 399/400
2013/0195500 A1* 8/2013 Saeki ..... G03G 15/2017 399/97
2013/0272744 A1* 10/2013 Wakayama ..... G03G 21/203 399/97
2014/0233979 A1* 8/2014 Namba ..... G03G 21/203 399/97
2014/0286665 A1* 9/2014 Minagawa ..... G03G 15/2017 399/69
2014/0341607 A1* 11/2014 Nakano ..... G03G 15/2017 399/92
2015/0030348 A1* 1/2015 Wachi ..... G03G 21/206 399/93
2015/0132020 A1* 5/2015 Saito ..... G03G 21/206 399/92
2015/0212485 A1* 7/2015 Wachi ..... G03G 21/206 399/93
2015/0212486 A1* 7/2015 Wachi ..... G03G 21/206 399/93
2015/0248084 A1* 9/2015 Uehara ..... G03G 21/206 399/92
2015/0338799 A1* 11/2015 Hamada ..... G03G 21/203 399/92
2016/0313694 A1* 10/2016 Wakimoto ..... G03G 21/206
2016/0370758 A1* 12/2016 Ogawa ..... G03G 21/206
2017/0185035 A1* 6/2017 Kawai ..... G03G 21/203
2018/0059585 A1* 3/2018 Kuroda ..... G03G 15/2017
2018/0088499 A1* 3/2018 Inada ..... G03G 15/011
2018/0253045 A1* 9/2018 Yukimoto ..... G03G 21/206
2018/0292782 A1* 10/2018 Nojima ..... G03G 21/206

* cited by examiner

IMAGE FORMING APPARATUS AND DEW CONDENSATION COUNTERMEASUREMENT SYSTEM

FIELD OF THE INVENTION AND RELATED ART

The present invention relates to an image forming apparatus and a dew condensation countermeasurement system.

For example, in an electrophotographic image forming apparatus, a sheet (recording material) on which an unfixed toner image is formed by an image forming portion is heated by a fixing portion (fixing device) for fixing the toner image on the sheet, so that water vapor generates in a casing of the fixing portion due to water content contained in the sheet.

The water vapor flows out of the fixing portion through a casing opening such as a sheet outlet provided in the casing and then flows toward above the fixing portion by natural convection, and is cooled by constituent members of a sheet feeding path in a main assembly of the image forming apparatus. The water vapor condenses and form water droplets, and the water droplets are attached to these constituent members. That is, dew condensation generates in some instances. Particularly, the dew condensation is liable to generate in the case where in a high-humidity environment, continuous sheet passing or the like is carried out immediately after a warm-up operation at the start of the day, and the water droplets due to the dew condensation are attached to the sheet and have the influence on an image and sheet feeding in some instances.

As a means for solving this problem, the water vapor is discharged to an outside of the main assembly of the image forming apparatus by frequently installing a discharging fan and a louver of an outer casing of the image forming apparatus, so that the sheet feeding path is dehumidified. For example, a method in which a louver for discharging vapor is provided at an upper portion of a fixing device in a main assembly of an image forming apparatus and a discharging path by natural convection is formed and in which lattice-shaped ribs are provided on a wall surface of the discharging path and dew condensation water is collected and dried has been known (Japanese Laid-Open Patent Application Hei 9-90855).

In recent years, with speed-up of printing by the image forming apparatus, an amount of generation of water vapor per unit time increases. However, noise reduction of a product progresses, and it is desired that leakage of noises, such as drive noise of motors for rotating a transfer roller, a fixing pressing roller and the like, drive noise of a fan, wind noise generating when wind passes through a louver, through the louver is suppressed. For that reason, it becomes difficult to install a discharging louver.

SUMMARY OF THE INVENTION

A principal object of the present invention is to provide an image forming apparatus capable of reducing dew condensation in the image forming apparatus without installing a discharging louver even when a water vapor generating portion such as a fixing portion exists.

According to an aspect of the present invention, there is provided an image forming apparatus comprising: an image forming portion configured to form a toner image on a recording material; a fixing portion configured to fix the toner image on the recording material by heating the toner image formed on the recording material; a duct provided above said fixing portion; a fan configured to blow air into said duct; and a water vapor moving portion through which water vapor generated in said fixing portion moves, wherein said water vapor moving portion is cooled by the air blowing in said duct.

Further features of the present invention will become apparent from the following description of exemplary embodiments with reference to the attached drawings.

BRIEF DESCRIPTION OF THE DRAWINGS

Parts (a) to (d) of FIG. 1 are schematic structural views of a principal part of an image forming apparatus in Embodiment 1.

DESCRIPTION OF EMBODIMENTS

In the following embodiments, unless otherwise specified, dimensions, materials, shapes and relative positions of constituent elements should be appropriately be changed depending on structures and various conditions of apparatuses (systems) to which the present invention is applied, and the scope of the present invention is not intended to be limited to the following embodiments.

Embodiment 1

(Image Forming Apparatus)

Figure 1:
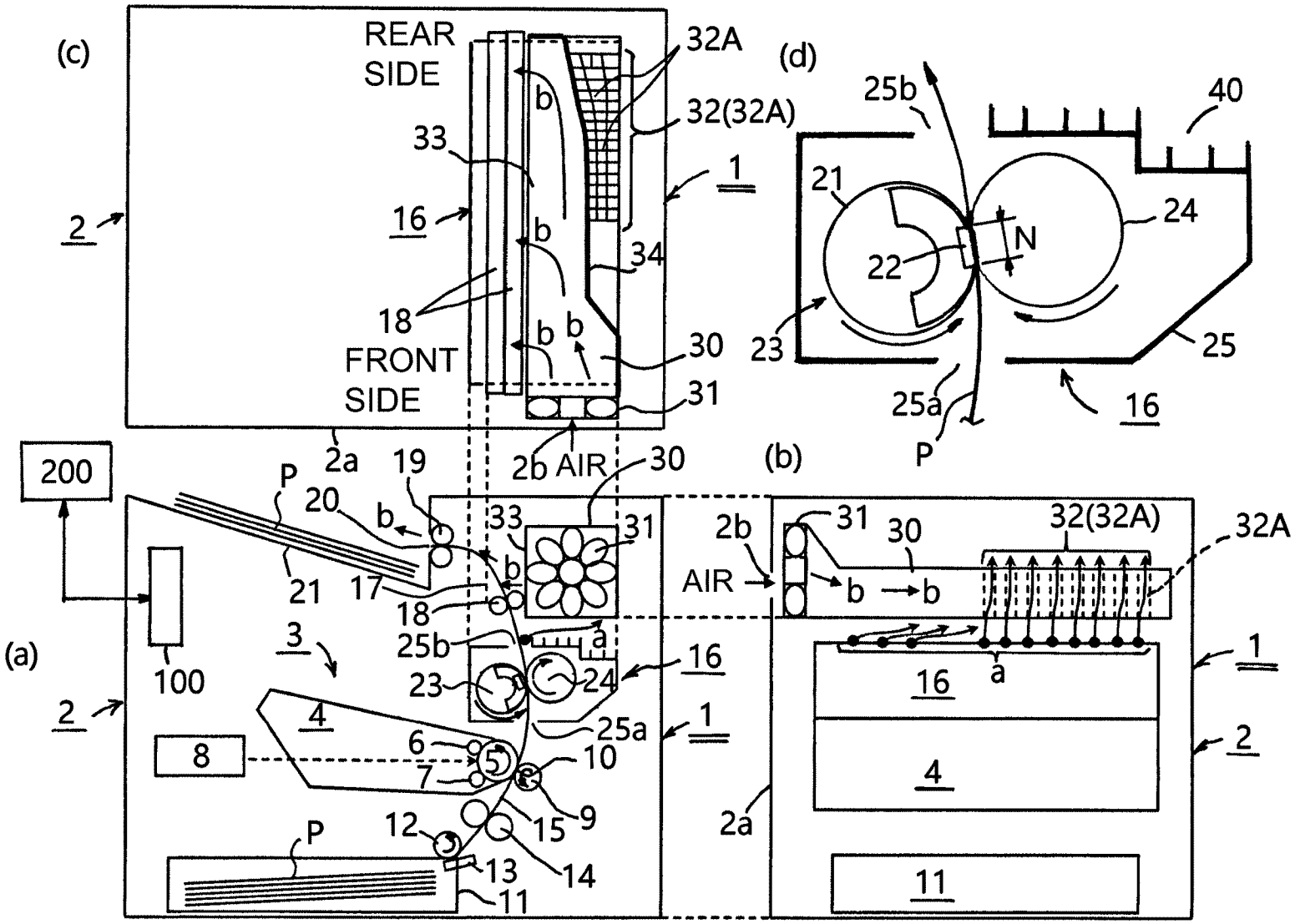

Parts (a) to (d) of FIG. 1 are schematic sectional views of an image forming apparatus 1 in this embodiment (Embodiment 1), in which part (a) is a schematic longitudinal front view of a principal part of the image forming apparatus 1, part (b) is a schematic side view of the principal part, part (c) is a schematic cross-sectional plan view of the principal part, and part (d) is an enlarged view of a fixing device portion (fixing portion).

Here, with respect to the image forming apparatus 1 of this embodiment, left and right are those as seen from a front surface side (part (a) of FIG. 1) of the image forming apparatus 1. The front surface side of the image forming apparatus 1 is a front side, and a rear surface side of the image forming apparatus 1 is a rear side. Upper and lower are those with respect to a direction of gravitation. Further, upstream and downstream are those with respect to a recording material feeding direction.

The image forming apparatus 1 is a monochromatic laser beam printer of an electrophotographic type, and electrical print job information is inputted from an external device 200 such as a personal computer to a controller 100. On the basis of the inputted print job information, the image forming apparatus 1 forms a toner image on a recording material P by an image forming operation of an image forming portion 3 in an image forming apparatus main assembly 2. In the following, for convenience, the recording material P is referred to as a sheet or paper, but is not limited to the paper.

The image forming portion 3 for forming an unfixed toner image on the sheet P includes a process cartridge 4 mountable in and dismountable from a predetermined mounting position in the apparatus main assembly 2. The process cartridge 4 is constituted by a photosensitive drum (image bearing member) 5 to be rotationally driven, a charging roller 6, a developing roller 7 and the like. Further, the image forming portion 3 includes a laser scanner unit (image exposure means) 8 and a transfer roller 9. An electrophotographic process and the image forming operation of the image forming portion 3 having the constitution as described above are well known and therefore will be omitted from detailed description thereof.

The sheets P accommodated in a sheet (paper) feeding cassette 11 provided below the image forming portion 3 are separated one by one by a sheet feeding roller 12 and a separation pad 13, and the separated sheet P is fed upward by a vertical feeding path (vertical path) 15 including a registration roller pair 14. Then, the sheet P is introduced into a transfer nip 10 which is a contact portion between the photosensitive drum 5 and the transfer roller 9, and during a process in which the sheet P is nipped and fed through the transfer nip 10, the unfixed toner image is transferred from the photosensitive drum 5 onto the sheet P.

The sheet P passed through the transfer nip 10 is separated from the photosensitive drum 5 and fed upward, and then is introduced into a fixing device 16 which is a fixing portion. The fixing device 16 heats the toner image formed on the sheet P and fixes the toner image as a fixed image on the sheet P.

[Fixing Portion]

The fixing device 16 which is the fixing portion is an on-demand fixing device of a belt (film) heating type and a pressing roller drive type in Embodiment 1. This is fixing device itself is known, and therefore, description thereof will be briefly made.

Referring to part (d) of FIG. 1, this fixing device 16 roughly includes:

a) a belt unit (fixing heating member) 23 including a cylindrical and flexible fixing belt (endless belt, first rotatable member: hereinafter referred to as a belt) as a fixing member, and a thin and elongated ceramic heater 22 as a heat source fixedly provided inside the belt 21, b) an elastic pressing roller (second rotatable member) 24 as a pressing member (fixing pressing member) for forming a nip (fixing nip, heating nip) N in which the toner image on the sheet P is heated and pressed and is fixed on the sheet P in cooperation with the belt unit 23, and c) a casing (fixing device frame) 25 accommodating the belt unit 23 and the pressing roller 24.

On a lower surface side and an upper surface side of the casing 25, a thin and elongated slit-like downward sheet inlet (opening) 25*a* and a thin and elongated slit-like upward sheet outlet (opening) 25*b* are provided, respectively, along a longitudinal direction of the opening area 25.

The heater 22 and the pressing roller 24 of the belt unit 23 are press-contacted to the belt 21 therebetween with predetermined pressure, so that the nip N having a predetermined width with respect to the sheet feeding direction is formed between the belt 21 and the pressing roller 24. That is, the nip N is formed by cooperation between the belt 21 and the pressing roller 24 which are used as a pair of rotatable members.

The pressing roller 24 is rotationally driven as a rotatable driving member at a predetermined peripheral speed in an arrow direction (clockwise direction) in part (d) of FIG. 1. With this rotational drive, in the nip N, a rotation torque acts on the belt 21 by a frictional force between the belt 21 and the pressing roller 24, so that the belt 21 is rotated in an arrow direction (counterclockwise direction) by rotation of the pressing roller 24 while being slid on and intimately contacted to a surface of the heater 22 at an inner surface thereof. Further, the heater 22 abruptly generates heat by electric power supply and is increased in temperature up to a predetermined fixing temperature, and then is temperature-controlled.

In this state of the fixing device 16, the sheet P on which the unfixed toner image fed from the image forming portion 3 side toward the fixing device 16 is formed enters the casing 25 from below toward above through the downward inlet 25*a* and is guided to the nip N. In the nip, the belt 21 rotates in contact with the toner image bearing surface of the sheet P. The sheet P is heated by heat of the belt 21 heated by the heater 22 in a process in which the sheet P is nipped and fed from below toward above through the nip N, and is subjected to nip pressure. As a result, the unfixed toner image is heated and pressed on the sheet P and thus is fixed on the sheet P.

The sheet P coming out of the nip N is sent toward above an outside of the casing 25 (or the fixing device 16) through the upward outlet 25*b* of the fixing device 16. Then, the sheet P is fed to a discharge opening 20 along a sheet feeding path (recording material feeding portion: discharge path) 17, and then is discharged as a product (image-formed product) onto a discharge tray 21 at an upper surface of the apparatus main assembly 2 through the discharge opening 20. The discharge opening 20 is a sheet outlet through which the sheet P sent upward from the fixing device 16 is discharged from the inside to the outside of the apparatus main assembly 2, and is disposed above the fixing device 16.

The sheet feeding path 17 which is a sheet discharging path is provided above the fixing device 16 and is constituted by a curl-suppressing roller pair 18, a sheeting guiding member (not shown), a discharging roller pair 19 and the like. The curl-suppressing roller pair 18 is disposed at a position close to the upward sheet outlet 25*b*, and the sheet discharging roller pair 19 is disposed at a position close to the discharge opening 20.

[Dew Condensation Countermeasurement System]

In the fixing device 16, when the introduced sheet P is heated in the nip N by the belt unit 23 which is the fixing heating member, water vapor generates inside the casing 25 by water content contained in the sheet P. That is, the water vapor generates in the fixing device 16. The water vapor generated in the casing 25 flows out of the casing 25 (or the fixing device 16) principally through the upward sheet outlet 25*b* and then flows toward above the fixing device 16 by natural convection in this embodiment. A problem occurring by this water vapor is roughly divided into the following two problems 1) and 2).

1) Problem of Dew Condensation

The water vapor condenses on a surface of a constituent component part in the fixing device 16 and generates a droplet of water (dew condensation water), and then the droplet of water attaches to the sheet P and causes an image defect or the like. Specifically, the water vapor convected toward above the fixing device 16 is condensed by being cooled above the fixing device 16 by the curl-suppressing roller pair 18, the guiding member (not shown), the discharging roller pair 19 and the like which constitutes the sheet feeding path 17, so that dew condensation occurs on these members in some instances. Then, droplets of water due to the dew condensation are attached to the sheet P and thus have the influence on the image and sheet feeding in some instances.

2) Problem of Misidentification as Smoke

In the case where the discharge opening of the apparatus main assembly 2 of the image forming apparatus 1 is small, when the water vapor in a large amount is discharged to the outside while water vapor can be visually recognized in some instances. This visually recognizable water vapor (steam) is misidentified as smoke in some instances.

As regards the problem 1), there is a need to suppress water vapor flowing into a site (sheet feeding path) where dew condensation is not intended to be generated by limiting a site of the dew condensation and then by promoting the dew condensation or to positively discharge the water vapor to the outside of the apparatus main assembly 2. As regards the problem 2), there is a need that the water vapor is not discharged to the outside of the apparatus main assembly 2 to the extent possible.

Accordingly, in order to compatibly realize necessity for the problems 1) and 2), there is a need that the site of the dew condensation is limited and the water vapor flowing into the sheet feeding path (also including a sheet feeding path for double-side printing) is suppressed. Therefore, in this embodiment (Embodiment 1), the following constitution in which the site of the dew condensation is limited is employed.

1) A duct 30 through which forced convection (current) b for making a temperature of a duct wall lower than a temperature of water vapor a which generates in the casing 25 of the fixing device 16 and flows to the outside of the casing 25 and which is convected toward above the fixing device 16 is caused to flow is provided above the fixing device (fixing portion) 16 which is a water vapor generating portion.

2) The duct 30 is provided with a fan 31 causing the forced convection b to flow.

Figure 2A:
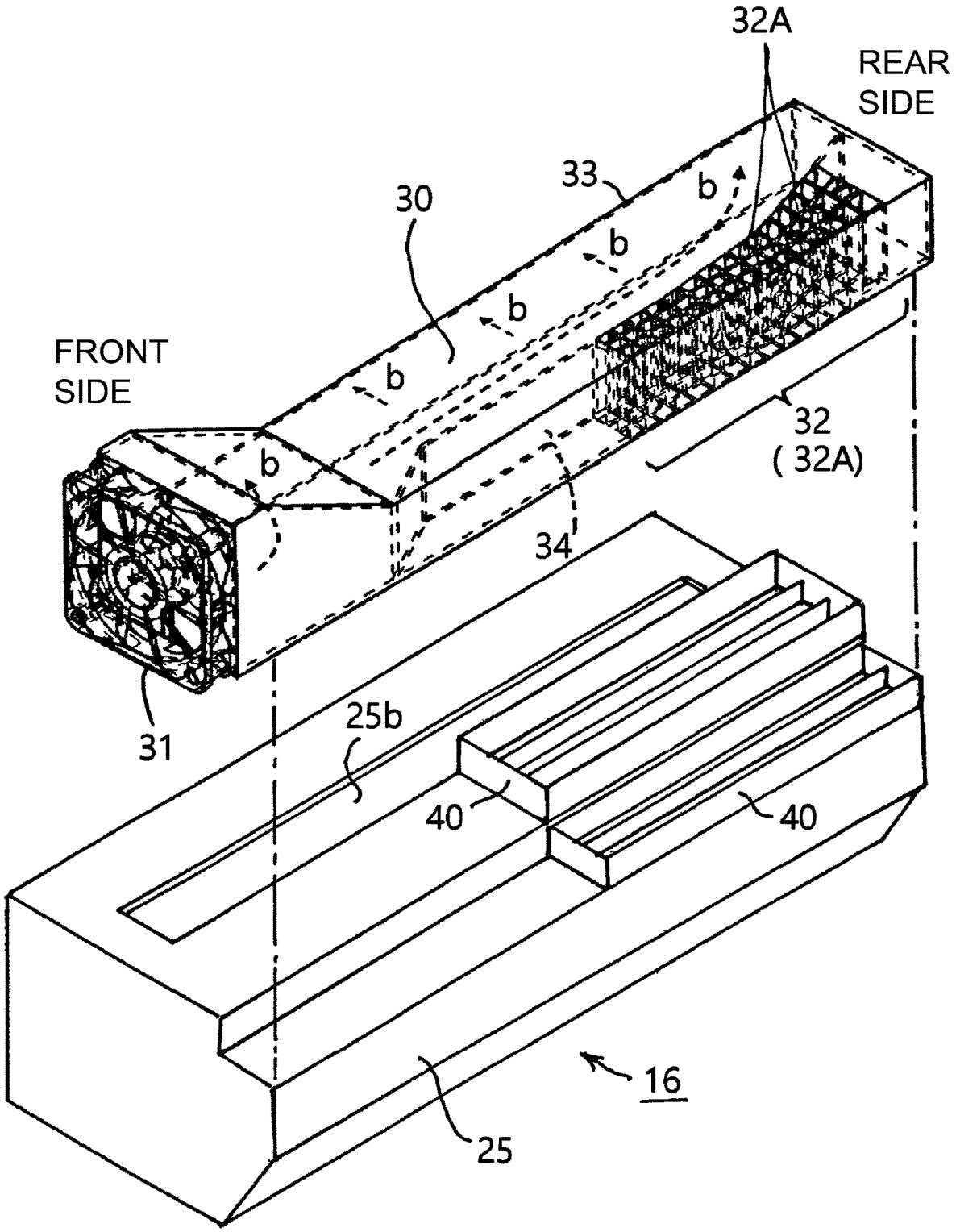
FIG. 2A is a schematic perspective view of an outer appearance of a fixing device (fixing portion) and a duct provided above the fixing device in the image forming apparatus.
Figure 2B:
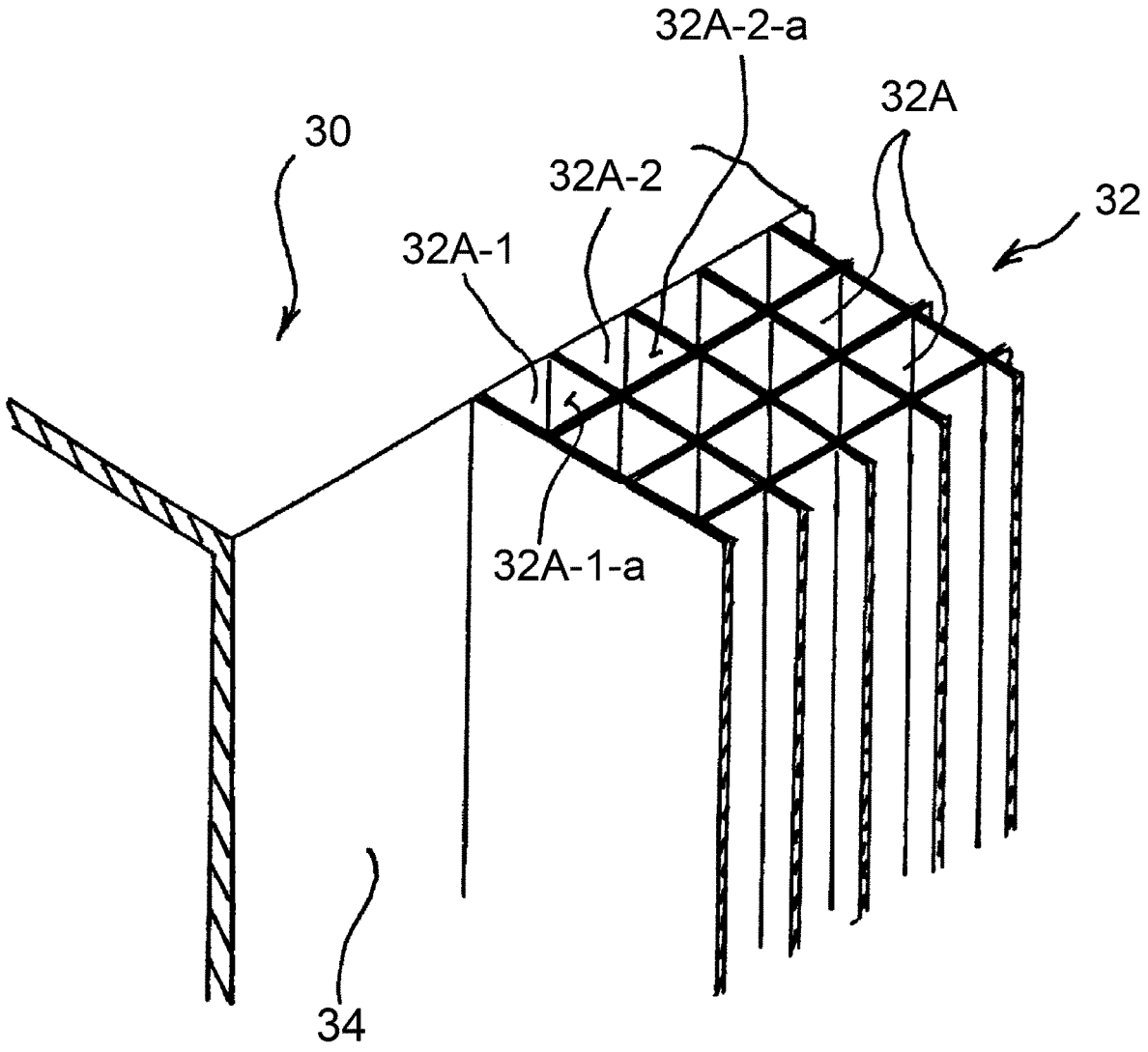
FIG. 2B is a partially enlarged view of a water vapor moving portion.

3) A water vapor moving portion 32 which is provided in the duct 30 and which includes at least a first hole 32A-1 and a second hole 32A-2 as dew condensation water collecting holes 32A at positions overlapping with the fixing device 16 as seen in a vertical direction. FIG. 2A is a partially enlarged schematic view of the dew condensation water collecting holes 32A shown in FIGS. 1 and 2A.

4) The first hole 32A-1 and the second hole 32A-2 of the water vapor moving portion 32 are provided adjacent to each other. Further, at least a part of a first hole wall **32A-1-*a* constituting the first hole 32A-1 and a part of a second hole wall 32A-2-*a* constituting the second hole 32A-2 are a part of a duct wall 34 of the duct 30**.

In the following, the above-described constitution will be specifically described. In this embodiment, the duct 30 is disposed above the fixing device (fixing portion) 16 in the apparatus main assembly 2 and is provided adjacent to the sheet feeding path 17 on the right side, and extends along the longitudinal direction of the fixing device 16. The water vapor moving portion 32 is in a position included in a range in which the fixing device 16 is projected onto a flat surface perpendicular to the vertical direction.

At least below the water vapor moving portion 32 with respect to the vertical direction, a water storing portion (water storing member, water storing shape portion) 40 is provided. The water storing portion 40 is a functional portion for receiving and storing dew condensation water dropped from the dew condensation water collecting holes 23A of the water vapor moving portion 32 so as not to cause an image defector or the like due to running-down of the dew condensation water on the sheet feeding path, and is, for example, a recess-shaped portion such as a dish-shaped container. The water storing portion 40 is not limited to the recess-shaped portion since a similar effect can also be obtained by a water-absorbing member or the like such as a sponge.

The water storing portion 40 may only be required to have a constitution including the water-absorbing member or a container-shaped portion capable of storing the dew condensation water at a position where the dew condensation water collected by the dew condensation water collecting holes 32A of the water vapor moving portion 32 is dropped. Or, a device constitution in which a feeding path of the sheet P does not exist at the position where the dew condensation water collected by the dew condensation water collecting holes 32A of the water vapor moving portion 32 is dropped may only be required.

In this embodiment, the water storing portion 40 is the dish-shaped portion disposed on an upper surface of the device frame 25 of the fixing device 16. The water storing portion 40 may also be disposed between below the water vapor moving portion 32 with respect to the vertical direction and the upper surface of the device frame 25 of the fixing device 16. In this embodiment, an example in which the water storing portion 40 was provided is described, but the water storing portion 40 may also be not provided when a constitution in which an amount of the dropped dew condensation water is small and the dew condensation water does not run on the sheet feeding path is employed.

FIG. 2A is a schematic perspective view of an outer appearance of the fixing device (fixing portion) 16 and the duct 30 provided with the water vapor moving portion 32. The duct 30 is adjacent to the sheet feeding path 17 on a side opposite from the discharge opening 20 with respect to the sheet feeding path 17 and extends along the longitudinal direction of the fixing device 16, and is open as an outlet portion 33 of the forced convection b on a side opposing the sheet feeding path 17.

In this embodiment, the fan 31 is connected to an end portion of the duct 30 on one end side (front side) with respect to the longitudinal direction of the duct 30, and sucks outside air (room temperature air) from a gap (window hole) provided in a front surface plate **2*a* of the apparatus main assembly 2 and causes the outside air as the forced convection b to flow into the duct 30. The water vapor moving portion 32 in this embodiment is disposed on a downstream side with respect to the longitudinal direction of the fixing device in the case where an installation place of the fan 31** disposed an upstream side.

The outside air is lower in temperature than the water vapor a which flows out of the fixing device 16 and which is convected toward above the fixing device 16. Accordingly, the duct wall of the duct 30 is cooled to a temperature lower than the temperature of the water vapor a which is convected toward above the fixing device 16 by the outside air which is the forced convection b flowing through the inside of the duct 30. In general, a temperature difference between the forced convection (outside air) b and the water vapor a is about 60° C., and a temperature difference between the duct wall collected by the forced convection b and the water vapor a is about 50° C.

The fan 31 is drive-controlled by a controller 100 and is placed in a driven state during the image forming operation of the image forming apparatus 1. The forced convection b caused to flow inside the duct 30 by the fan 31 flows toward the sheet feeding path 17 through the opening 33 of the duct 30 which opposes and opens to the sheet feeding path 17. As a result, the constituent member, such as the curl-suppressing roller pair 18, of the sheet feeding path 17 is cooled by the forced convection b coming out of the duct 30 through the opening 33. Then, the forced convection b flowing toward the sheet feeding path 17 through the opening 33 of the duct 30 principally moves to the outside of the apparatus main assembly 2 through the discharge opening 20.

Further, when the sheet P sent from the fixing device 16 is fed in the sheet feeding path 17, the heated sheet P is cooled by the forced convection b coming out of the duct 30 through the opening 33 in a process in which the sheet P is fed in the sheet feeding path 17. Then, the forced convection b flows toward the discharge opening 20 side along a back surface of the sheet P and principally moves to the outside of the apparatus main assembly 2 through the discharge opening 20.

The water vapor moving portion 32 at least includes the first and second holes as the dew condensation water collecting holes 32A through which the water vapor moves. The first and second holes are tubular portions provided adjacent to each other via the first hole wall, and a part of the first hole and a part of the second hole are a part of the duct wall. In this embodiment, the water vapor moving portion 32 is provided in a honeycomb form with vertically lattice-shaped holes on an outer wall surface of the duct 30 on a rear surface side (opposite from the opening 33 side). That is, a plurality of dew condensation water collecting holes 32A are formed so as to be adjacent to each other.

On the rear surface side of the duct 30, with respect to the wall surface of the duct 30 on which the forced convection b flows, when the wall surface contacting the forced convection b is referred to as an inner wall and a wall opposite from the inner wall is an outer wall, the dew condensation water collecting holes 32A of the water vapor moving portion 32 are constituted, as a part thereof, by the outer wall (surface) of the duct 30. For that reason, the wall surfaces of the dew condensation water collecting holes 32A of the water vapor moving portion 32 are in a state in which the wall surfaces of the dew condensation water collecting holes 32A are cooled to substantially the same temperature as the wall surface of the duct 30. In this embodiment, the water vapor moving portion 32 is disposed in a substantially rear half portion of the duct 30 with respect to the longitudinal direction of the duct 30, but may also be disposed over a substantially full-length portion of the duct 30 with respect to the longitudinal direction.

In the above-described constitution, the water vapor generated inside the casing 25 of the fixing device 16 by introducing the sheet P into the fixing device 16 principally flows out of the casing 25 through the upward sheet outlet 25*b* and then flows toward above (immediately above) the fixing device 16 with respect to the vertical direction by natural convection in this embodiment.

In this embodiment, above the fixing device 16, the sheet feeding path 17 for feeding the sheet, coming out of the fixing device 16 through the sheet outlet 25*b*, to the discharge opening 20 is disposed, and the curl-suppressing roller pair 18 of the sheet feeding path 17 exists at a position close to the sheet outlet 25*b*. For that reason, the water vapor a flowing toward above the fixing device 16 through the sheet outlet 25*b* with respect to the vertical direction is substantially blocked from flowing toward the discharge opening 20 along the sheet feeding path 17 by this curl-suppressing roller pair 18 which constitute an obstacle thereto, so that most of the water vapor a enters in the horizontal direction between the lower surface of the duct 30 and the upper surface of the casing 25.

When the sheet is fed in the sheet feeding path 17, the normal convection of the water vapor coming out of the fixing device 16 through the sheet outlet 25 is not readily discharged along a discharge path on the front and back surfaces of the sheet and is convected between the lower surface of the duct 30 and the upper surface of the casing 25. Further, even the convection on the front surface of the sheet, an upper discharge path is substantially blocked by the curl-suppressing roller pair 18, and therefore detours around the sheet and merges with the convection on the back surface. Further, the forced convection b is blown against the curl-suppressing roller pair 18, so that pressure in the neighborhood of the curl-suppressing roller pair 18. Therefore, the water vapor coming out of the fixing device 16 through the sheet outlet 25*b* and convected toward above the fixing device 16 does not readily flows in a direction toward the curl-suppressing roller pair 18.

From the above, of the water vapor coming out of the fixing device 16 toward above the fixing device 16 through the sheet outlet 25*b*, in terms of a proportion, an amount of the convection toward the path between the lower surface of the duct 30 and the upper surface of the casing 25 is about 80% to 90%, and an amount of the convection in the path toward the discharge opening 20 is about 20% to 10%.

The natural convection basically flows upward in the vertical direction, but in the case where an obstacle exists at an upper portion thereof, the natural convection flows upward while detouring around the obstacle. This flow can also be called the natural convection even when a flow speed direction fluctuates depending on a wind path. In this embodiment, the curl-suppressing roller pair 18 blocks the sheet discharge path of the sheet feeding path 17. That is, the obstacle exists in the sheet discharge path, and the flow of the water vapor coming out of the fixing device 16 through the sheet outlet 25*b* enters in the horizontal direction between the lower surface of the duct 30 and the upper surface of the casing 25 so as to detour the obstacle and then is convected therebetween.

The water vapor a which horizontally enters between the lower surface of the duct 30 and the upper surface of the casing 25 and which is convected therebetween is guided toward the downward opening of the dew condensation water collecting holes 32A of the water vapor moving portion 32 and flows inside the dew condensation water collecting holes 32A from below toward above. Then, the water vapor a flowing inside the dew condensation water collecting holes 32A condenses and causes dew condensation by the temperature difference (about 50° C.) between the duct wall of the duct 30 cooled by the forced convection b and the wall surface of the dew condensation water collecting holes 32A in the water vapor moving portion 32 cooled to the substantially same temperature as the temperature of the duct wall. That is, dehumidification of the air containing the water vapor a is carried out by the dew condensation water collecting holes 32A.

For that reason, the dehumidified air gets out of the dew condensation water collecting holes 32A through the upward opening and passes between the upper surface of the duct 30 and an inner surface of a ceiling plate and detours around the duct 30 toward the opening 33 side of the duct 30 and thus is convected. Then, the dehumidified air is carried on the forced convection b sent from the opening 33 toward the sheet feeding path 17 and is discharged together with the forced convection b to the outside of the apparatus main assembly 2 through the discharge opening 20. The flow of this dehumidified air is based on the natural convection and negative pressure by the flow of the forced convection b sent from the opening 33 of the duct 30 toward the sheet feeding path 17.

The dehumidification of the air containing the water vapor is not limited to the dew condensation water collecting holes 32A in the water vapor moving portion 32, but is also made by dew condensation of the water vapor generated by the temperature difference between the duct wall and the water vapor a also on the duct walls at the lower surface, the back surface and the upper surface of the duct 30 cooled by the forced convection b. Particularly, efficient dew condensation and efficient dew condensation collection are carried out by movement of the water vapor a through the dew condensation water collecting holes 32A in the water vapor moving portion 32, so that the dehumidification is performed.

Incidentally, in part (b) of FIG. 1, as regards upward flow of the water vapor a flowing toward the dew condensation water collecting holes 32A of the water vapor moving portion 32, water vapor at a portion which does not correspond to the water vapor moving portion 32 is drawn so as to move in a direction toward the water vapor moving portion 32. This is because a byway discharge path is limited. In the above-described portion which does not correspond to the water vapor moving portion 32, the water vapor flowing through the back surface side of the duct 30 also exists. However, a part of the water vapor flows as illustrated in part (b) of FIG. 1, and therefore, from the viewpoint of ease of understanding, the flow of the water vapor flowing toward above on the back surface side of the duct 30 is omitted from illustration.

As described above, also in the case where the dew condensation water drops through the dew condensation water collecting holes 32A, the water storing portion 40 is prepared at least below the water vapor moving portion 32 so as not to cause the image defect or the like by running-down of the dew condensation water on the sheet feeding path.

Figure 3:
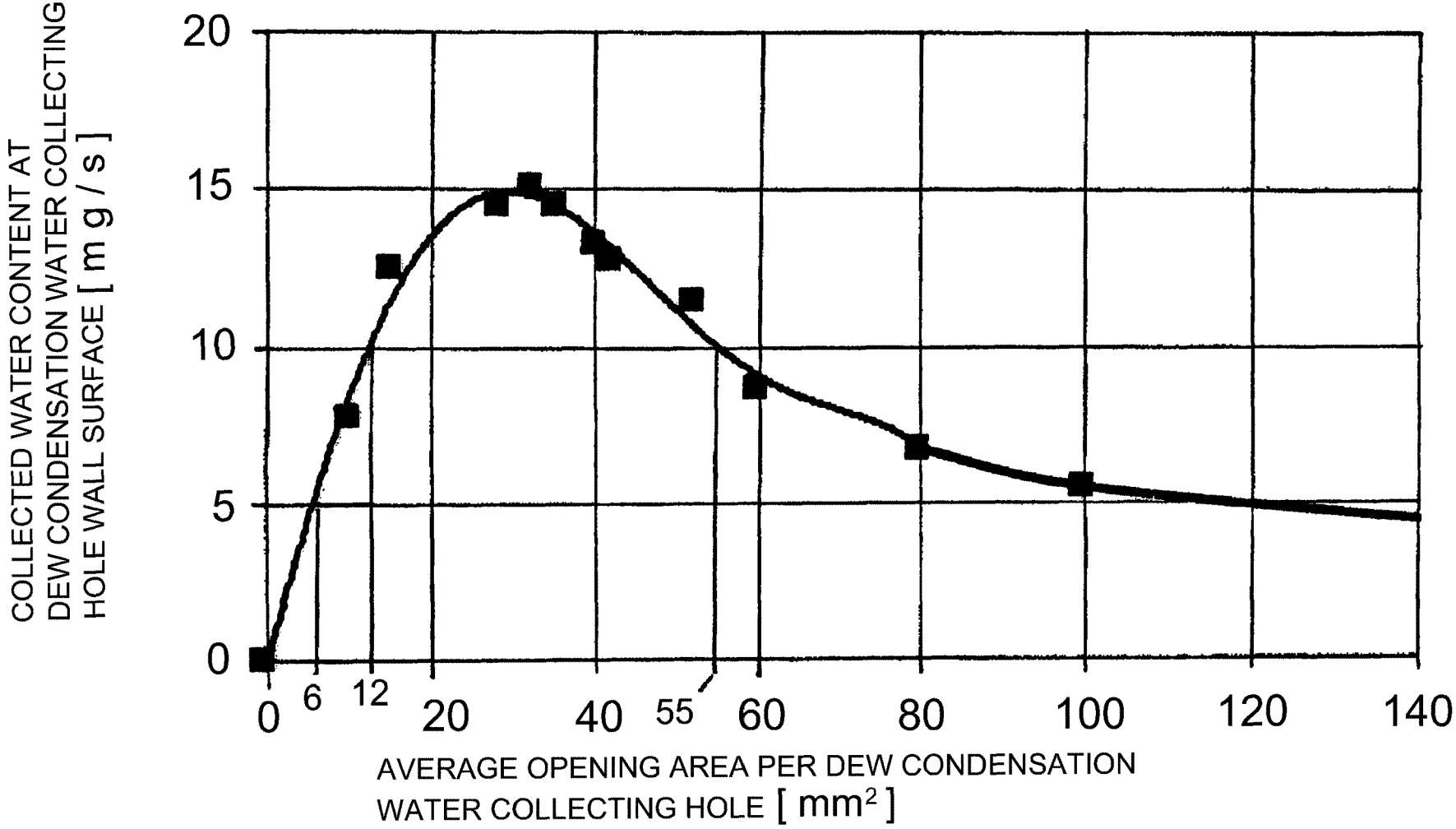
FIG. 3 is a graph showing a relationship, derived by simulation, between an opening area of a dew condensation water collecting hole and a collected water content in the water vapor moving portion.

Next, an average opening area per (one) hole of the dew condensation water collecting holes 32A through which the water vapor passes (i.e., an opening area per (one) cross-sectional surface of the those of the dew condensation water collecting holes 32A) will be described. FIG. 3 shows the average opening area per (one) dew condensation water collecting hole of the duct 30 and a collected water content of the dew condensation water collecting hole 32A in this embodiment (Embodiment 1). According to FIG. 3, there is a peak in a relationship between the opening area per dew condensation water collecting hole and the water vapor of the water vapor capable of being collected by the hole wall surface. In the dew condensation water collecting hole 32A, when the collected water content in FIG. 3 is larger than 0, the dew condensation occurs.

The opening area of the dew condensation water collecting hole 32A may preferably be large from the viewpoint of flowing-in of the water vapor a, and the number of the holes may preferably be large in order to increase a dew condensation water collecting area. However, in the image forming apparatus 1, a region in which the dew condensation water collecting holes 32A can be provided is limited, and therefore, when the opening area of the holes is increased, the number of the holes decreases, so that the dew condensation water collecting area becomes small and thus the collected water content also decreases. On the other hand, in the case where the dew condensation water collecting area is intended to be increased, when the number of the holes is increased, the opening area of the holes becomes small, so that the water vapor does not readily flow into the holes, and therefore, the collected water content decreases.

Incidentally, in FIG. 3, as a factor relating to the collected water content [mg/s] of the dew condensation water collecting hole wall surface which is the ordinate, other than the average opening area per (one) hole which is the abscissa, it is possible to use water vapor density, a temperature difference between the water vapor and the wall surface, a flow speed of the water vapor, a length of the hole, and the like. FIG. 3 shows the collected water content [mg/s] obtained by only changing the average opening area in a condition that all of the other factors are the same. However, as regards the flow speed, it somewhat fluctuates due to a fluctuation in hole opening area.

From the above, as regards the average opening area of the one dew condensation water collecting hole 32A, it can be said that when the average opening area is 6 $mm^2$ or more and 120 $mm^2$ or less which corresponds to the collected water content of 5 mg/s or more, dew condensation water collecting efficiency is in a high state. Especially, a range of 12 $mm^2$ or more and 55 $mm^2$ or less which corresponds to the collected water content of 10 mg/s is a preferred range.

Incidentally, the shape of the dew condensation water collecting holes 32A is not limited to the lattice shape in this embodiment, but a similar collecting effect can be obtained also in a circular shape, a triangular shape, other polygonal shapes, and the like shape.

As described above, in the image forming apparatus 1 of this embodiment, most of the water vapor convected toward above from the fixing device 16 is dehumidified (dewatered) as the dew condensation water by the duct 30 cooled by the forced convection b and the dew condensation water collecting holes 32 in the water vapor moving portion 32. That is, the site of the dew condensation of the water vapor convected upward from the fixing device 16 is limited to the duct 30 and the dew condensation water collecting holes 32A and the dew condensation is promoted in this site, so that the water vapor flowing into the sheet feeding path 17 which is the sheet feeding path in which the dew condensation is not intended to be caused to occur is suppressed.

For that reason, the discharge opening for permitting discharge of the water vapor to the outside of the apparatus main assembly is sufficient when the discharge opening 20 of the sheet P also functions as the discharge opening as in this embodiment, so that there is no need to provide an exclusive discharge louver. Further, as the fan 31 for discharging the water vapor, it is possible to use a fan which has a small discharge amount and which is therefore small in drive noise, so that it becomes possible to reduce the noise of the image forming apparatus.

Thus, even when the exclusive discharge louver for discharging the water vapor generating from the fixing device 16 is not provided, the inside of the image forming apparatus is dehumidified and thus the dew condensation on the sheet feeding path can be suppressed, so that it is possible to suppress the influence of attachment of droplets of water by dew condensation, on the image and the sheet feeding. Further, the amount of the water vapor discharged to the outside of the apparatus main assembly 2 of the image forming apparatus 1 is small, so that the problem of misidentification as the smoke is also eliminated.

Embodiment 2

Figure 4A:
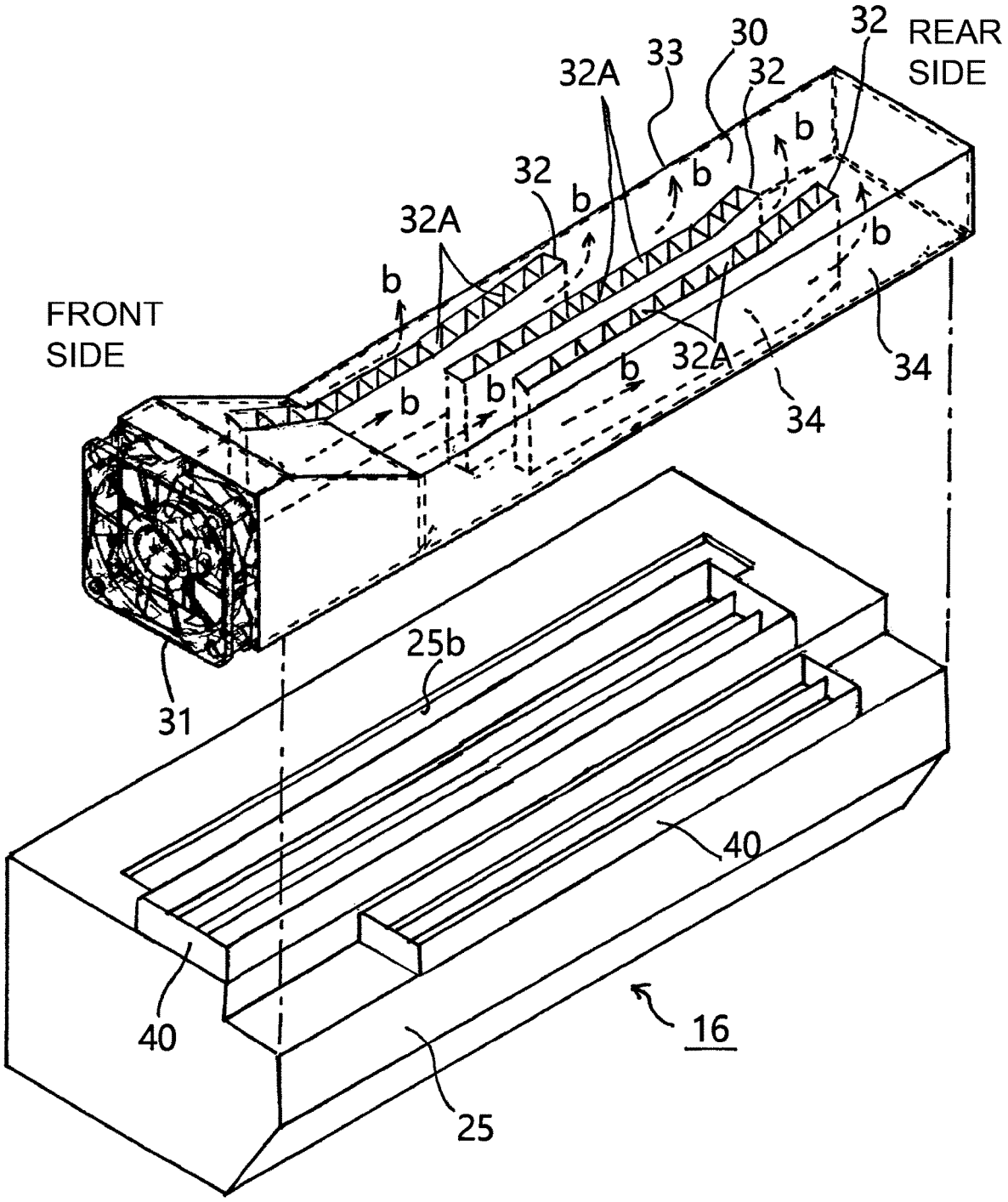
FIG. 4A is a schematic perspective view of an outer appearance of a fixing device (fixing portion) and a duct provided above the fixing device in Embodiment 2.
Figure 4B:
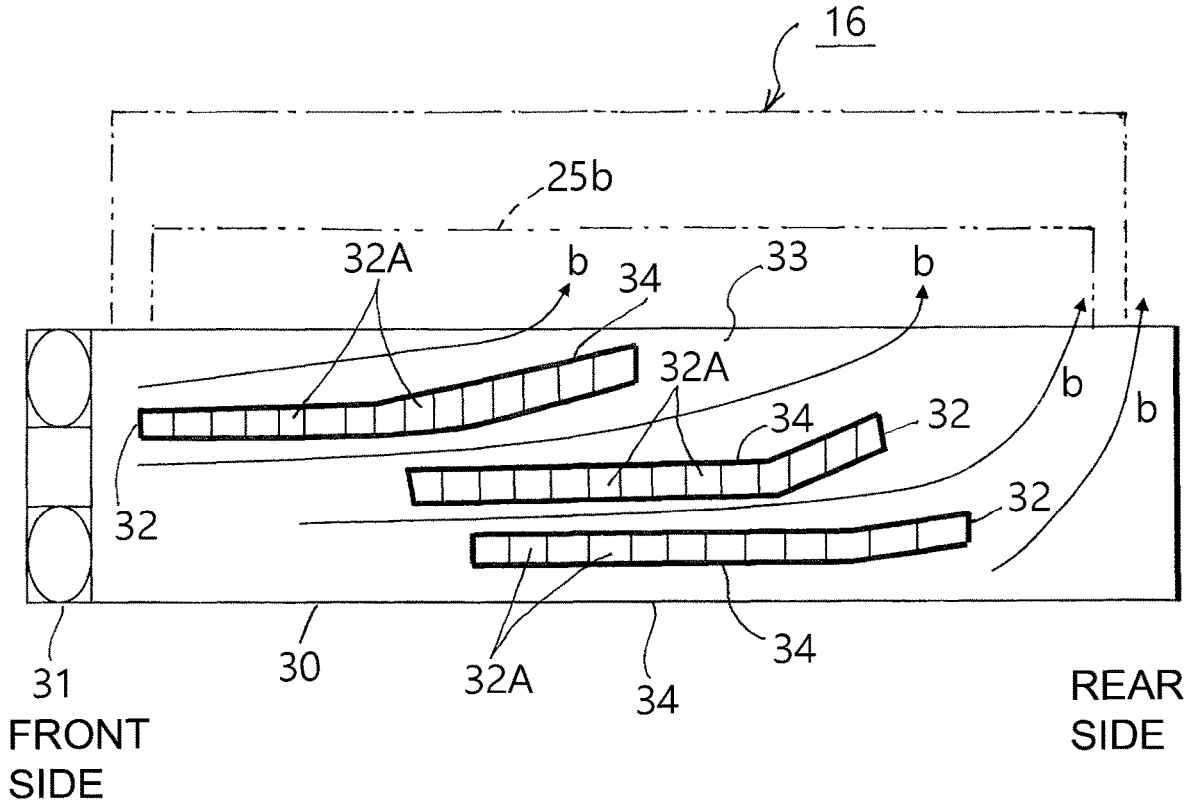
FIG. 4B is a schematic longitudinal plan view of the duct of FIG. 4A.

FIG. 4A is a schematic perspective view of an outer appearance of a fixing device 16 and a duct 30 provided above the fixing device 16 in this embodiment (Embodiment 2), and FIG. 4B is a schematic cross-sectional plan view of the duct 30. This duct 30 is disposed similar as the case of the duct 30 in the image forming apparatus 1 in Embodiment 1 as shown in FIG. 1, and therefore, will be omitted from redundant description. Herein, a constitution as a feature of this embodiment will be described.

In Embodiment 2, water vapor moving portions 32 including dew condensation water collecting holes 32A are provided in a wind path of the duct 30 in which the forced convection b flows. In this embodiment, the water vapor moving portions 32 including the dew condensation water collecting holes 32A are provided inside (in the wind path) of the duct 30 in a plurality of rows. The water vapor moving portion 32 in each of the rows extends in a longitudinal direction of the duct 30, and the respective water vapor moving portions 32 are disposed with intervals with respect to a widthwise direction, in a longitudinal flat surface of the duct 30. In this embodiment, three rows of the water vapor moving portions 32 are disposed inside the duct 30. The water vapor moving portion 32 in each row includes a plurality of dew condensation water collecting holes 32A arranged adjacent to each other in the longitudinal direction. Each of the dew condensation water collecting holes 32A penetrates through the duct 30 from the bottom to an upper surface of the duct 30.

By drive of the fan 31, the forced convection b caused to flow into the duct 30 passes between the respective rows of the water vapor moving portions 32 and between the rear surface plate and the water vapor moving portion 32 of the duct 30, and flows into the duct 30 and then comes out of the duct 30 through an opening 33. A wall surface of the dew condensation water collecting hole 32A of each of the rows of the water vapor moving portions 32 is constituted by a duct wall 34.

A proportion of the duct wall surface constituting the dew condensation water collecting holes 32A is larger than that of the dew condensation water collecting holes 32A in Embodiment 1. The duct wall surface constituting the dew condensation water collecting holes 32A on an inner wall side is cooled by the forced convection b, and therefore, an average wall surface temperature of the dew condensation water collecting holes 32A is lower than that of the dew condensation water collecting holes 32A in Embodiment 1, so that dew condensation is promoted and collection dew condensation water is also promoted. A shape of the dew condensation water collecting holes 32A is not limited to a lattice shape, but a similar collecting effect can also be obtained by a circular shape, a triangular shape or the like.

It is also possible to employ a constitution in which the water vapor moving portion 32 including the dew condensation water collecting holes 32A is disposed both outside the duct 30 as in Embodiment 1 and inside (in the wind path of) the duct 30 as in Embodiment 1.

Comparison Example

Figure 5:
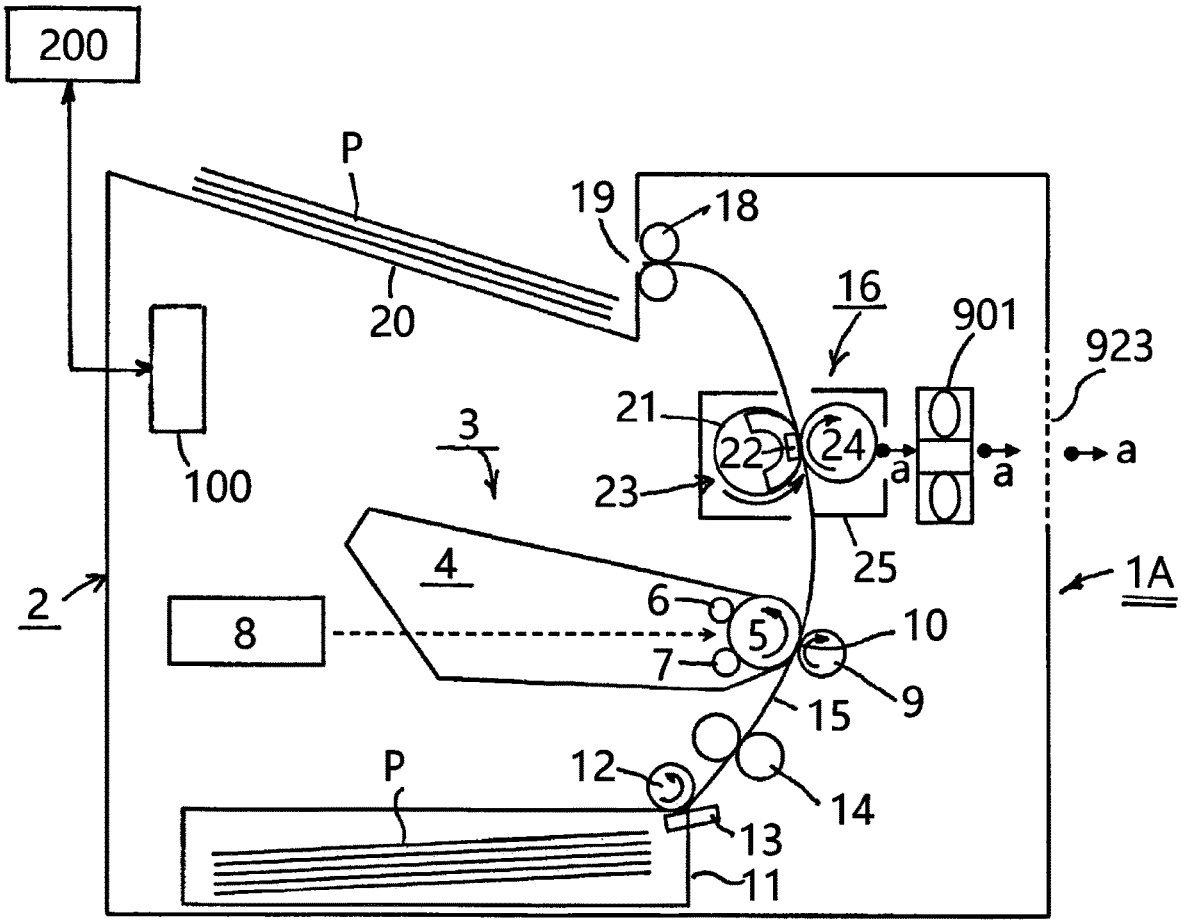
FIG. 5 is a schematic structural view of an image forming apparatus in a comparison example.

FIG. 5 is a schematic structural view of an image forming apparatus 1A of a comparison example. Constituent members and portions common to the image forming apparatus 1A of this comparison example and the image forming apparatus 1 of Embodiment 1 (FIG. 1) are represented by the same reference numerals or symbols and will be omitted from redundant description. The image forming apparatus 1A has a constitution in which the water vapor is discharged by providing a fan and a louver of an outer casing and in which a sheet feeding path is dehumidified.

That is, in order to discharge the water vapor a generated in the fixing device 16 to the outside of the image forming apparatus 1A without being dehumidified (dewatered) as the dew condensation water by the duct 30 and the water vapor moving portion 32 including the dew condensation water collecting holes 32A as in Embodiments 1 and 2, a discharging fan 901 and a discharging louver 923 are provided. In this case, the discharging fan 901 is required to have a large discharge amount.

For that reason, from the image forming apparatus 1A of the comparison example, noise such as drive noise of the fan 901 and wind noise generating when wind passes through the louver 923 is leaked, and it is difficult to suppress the noise. In the image forming apparatus 1A of the comparison example, a difference in noise level between before and after the louver 923 is closed was about 0.04 [B].

Other Embodiments (1) The fixing device 16 as the fixing portion is not limited to the fixing device of the belt heating type and the pressing roller drive type in Embodiments 1 and 2. It is possible to employ conventionally known fixing devices of various heating types such as a heating roller type, a heat chamber type, a heat plate type, and an infrared irradiation type.

(2) The fixing device 16 includes an image improving device for improving gloss (glossiness) of a once-fixed or tentatively fixed image on the recording material (fixed image or semi-fixed image) (also in this case, the device is referred to as the fixing device).

(3) The image forming apparatus 1 described using the printer as an example is not limited to the image forming apparatus for forming the monochromatic image but may also be an image forming apparatus for forming a color image. Further, the image forming apparatus can be carried out in various uses, such as a copying machine, a facsimile machine, and a multi-function machine having functions of these machines, by adding necessary device, equipment and casing structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-146489 filed on Aug. 3, 2018, which is hereby incorporated by reference herein in its entirety.

What is claimed is:

1. An image forming apparatus comprising:

an image forming portion configured to form a toner image on a recording material;

a fixing portion configured to fix the toner image on the recording material by heating the toner image formed on the recording material;

a duct provided above said fixing portion and comprising an air path; and a fan configured to blow air into said air path, wherein said duct further comprises a water vapor moving portion through which water vapor generated in said fixing portion moves, and wherein said water vapor moving portion is separated by a wall of said duct and provided across said air path and is cooled by the air blowing in said air path.

2. An image forming apparatus according to claim 1, further comprising:

a discharge opening provided above said fixing portion and configured to permit discharge of the recording material from an inside to an outside of said image forming apparatus; and a recording material feeding portion configured to feed the recording material, fed above from said fixing portion, toward said discharge opening, wherein said duct extends along a longitudinal direction of said fixing portion so as to be provided adjacent to said recording material feeding portion, and wherein said water vapor moving portion is provided so as to be disposed on a side opposite from said recording material feeding portion with respect to said air path.

3. An image forming apparatus according to claim 1, further comprising:

a discharge opening provided above said fixing portion and configured to permit discharge of the recording material from an inside to an outside of said image forming apparatus; and a recording material feeding portion configured to feed the recording material, fed above from said fixing portion, toward said discharge opening, wherein said duct extends along a longitudinal direction of said fixing portion so as to be provided adjacent to said recording material feeding portion.

4. An image forming apparatus according to claim 1, wherein said water vapor moving portion has a first hole and a second hole, and wherein said first hole and said second hole are provided adjacent to each other, and at least a part of a first hole wall constituting said first hole and a part of a second hole wall constituting said second hole are a part of said wall.

5. An image forming apparatus according to claim 4, wherein each of said first hole and said second hole has an average opening area of 6 $mm^2$ or more and 120 $mm^2$ or less.

6. An image forming apparatus according to claim 4, wherein each of said first hole and said second hole has an average opening area of 12 $mm^2$ or more and 55 $mm^2$ or less.

7. An image forming apparatus according to claim 1, further comprising a water storing portion or a water storing shape portion at a position where dew condensation water collected by said water vapor moving portion is dropped.

8. An image forming apparatus according to claim 1, further comprising a recording material feeding path which is absent at a position where dew condensation water collected by said water vapor moving portion is dropped.

9. An image forming apparatus according to claim 1, wherein said fixing portion includes first and second rotatable members configured to form a nip for heating the toner image on the recording material.

10. A dew condensation countermeasurement system comprising:

a water vapor generating portion;

a duct provided above said water vapor generating portion and comprising an air path; and a fan configured to blow air into said air path, wherein said duct further comprises a water vapor moving portion through which water vapor generated in said water vapor generating portion moves, and wherein said water vapor moving portion is separated by a wall of said duct and provided across said air path and is cooled by the air blowing in said air path.

11. A dew condensation countermeasurement system according to claim 10, wherein said water vapor moving portion has a first hole and a second hole, and wherein said first hole and said second hole are provided adjacent to each other, and at least a part of a first hole wall constituting said first hole and a part of a second hole wall constituting said second hole are a part of said wall.

12. A dew condensation countermeasurement system according to claim 11, wherein each of said first hole and said second hole has an average opening area of 6 $mm^2$ or more and 120 $mm^2$ or less.

13. A dew condensation countermeasurement system according to claim 11, wherein each of said first hole and said second hole has an average opening area of 12 $mm^2$ or more and 55 $mm^2$ or less.

14. A dew condensation countermeasurement system according to claim 10, further comprising a water storing portion or a water storing shape portion at a position where dew condensation water collected by said water vapor moving portion is dropped.

15. A dew condensation countermeasurement system according to claim 10, wherein said water vapor moving portion is a fixing device configured to fix a toner image on a recording material by heating the toner image formed on the recording material.

* * * * *